US007238081B2

(12) United States Patent
Fildan et al.

(10) Patent No.: US 7,238,081 B2
(45) Date of Patent: Jul. 3, 2007

(54) REVERSIBLE SHOULDER STRAP FOR A GARMENT, ESPECIALLY A BRASSIERE

(75) Inventors: Gerhard Fildan, Vienna (AT); Karl Wanzenböck, Leobersdorf (AT)

(73) Assignee: Fildan Accessories Corporation, Humble, TX (US)

( * ) Notice: Subject to any disclaimer, the term of this patent is extended or adjusted under 35 U.S.C. 154(b) by 349 days.

(21) Appl. No.: 10/846,160

(22) Filed: May 13, 2004

(65) Prior Publication Data

US 2005/0255791 A1 Nov. 17, 2005

(51) Int. Cl.
*A41C 3/12* (2006.01)
*A41C 3/00* (2006.01)

(52) U.S. Cl. ..... 450/86; 450/88

(58) Field of Classification Search ..... 450/86, 450/88, 54, 580, 83–85, 87; 2/310–312, 2/323–327, 336, 338
See application file for complete search history.

(56) References Cited

U.S. PATENT DOCUMENTS 911,204 A * 2/1909 Busby ..... 450/86
2,423,046 A * 6/1947 Patterson ..... 450/86
2,482,994 A * 9/1949 Wiley ..... 450/32
2,619,651 A * 12/1952 Leonard ..... 2/320
2,753,569 A * 7/1956 Schmalz ..... 2/323
2,916,742 A * 12/1959 Sobel ..... 2/322
3,506,014 A * 4/1970 Sorenson ..... 450/60
3,848,270 A * 11/1974 Rand ..... 2/311
4,481,682 A * 11/1984 Hall ..... 2/326
6,006,364 A * 12/1999 Newsom et al. ..... 2/323
6,135,853 A * 10/2000 Hopson ..... 450/86
6,155,906 A * 12/2000 May ..... 450/88

* cited by examiner

*Primary Examiner*—Gloria M. Hale
(74) *Attorney, Agent, or Firm*—Andrew Wilford

(57) ABSTRACT

A reversible adjustable shoulder strap which can be used with high versatility in a variety of strap patterns, for a brassiere, has a strip formed with injection mold male and female closure members which can mate with one another and are identical on either side of the strip.

11 Claims, 7 Drawing Sheets

REVERSIBLE SHOULDER STRAP FOR A GARMENT, ESPECIALLY A BRASSIERE

FIELD OF THE INVENTION

Our present invention relates to a reversible adjustable shoulder strap for a garment, especially a brassiere and, more particularly, to a shoulder strap that can be used with great versatility in a variety of support patterns for the brassiere.

BACKGROUND OF THE INVENTION

Garments having shoulder straps, for example, brassieres, normally have those shoulder straps fixed in place and adjustable, for example, by pulling an end of the shoulder strap to a greater or lesser extent through a buckle to vary the effective length of that strap.

There are garments in which the shoulder strap is replaceable, for example to change the color, texture or other character of the shoulder strap, but generally even in such garments the shoulder strap assumes a standard pattern, e.g. connecting the right side of the front of the garment to the right side of a back of the garment or the left side of the front of the garment to the left side of the back, passing over the right or left shoulder respectively.

Such replaceable straps are generally affixed with D-rings and clip arrangements which are difficult to use, interfere with laundering and may be uncomfortable to the wearer.

OBJECTS OF THE INVENTION

It is the principal object of the present invention to provide a reversible and adjustable shoulder strap which can be used for any garment requiring a shoulder strap but is especially suitable for a brassiere, and which solves problems encountered with earlier shoulder straps.

Another object of the invention is to provide a brassiere which can be worn with greater versatility than earlier brassieres, especially with respect to the shoulder strap pattern.

SUMMARY OF THE INVENTION

These objects and others which will become apparent hereinafter are attained, in accordance with the invention in a reversible adjustable shoulder strap for a garment which comprises a flexible strip flexible strip formed at opposite ends with first annular snap closure members and between the first snap closure members a plurality of spaced-apart second annular closure members, one of the first and second closure members being male closure members and the other of the first and second closure members being female closure members, each of the closure members being identical on both broad sides of the strip, the male closure members having studs and the female closure members having openings releasably receiving the studs in respective snap connections.

According to a feature of the invention the male closure members are provided at the ends of the strip. A further strip, also having such male and female closure members can be connected to the first mentioned strip to thereby extend a length of the shoulder strap and/or an extender can be provided which comprises a flexible strip formed with rings on ends thereof through which a strip carrying these closure members can pass to also thereby extend the length of the shoulder strap.

A brassiere which embodies the invention can comprise: a pair of brassiere cups and a back strap connected to the cups, each of the cups having a respective annular snap closure member and the back strap having a pair of spaced-apart annular snap closure members; and a reversible adjustable shoulder strap comprising a flexible strip formed at opposite ends with first annular snap closure members and between the first snap closure members a plurality of spaced-apart second annular closure members, one of the first and second closure members being male closure members and the other of the first and second closure members being female closure members, each of the closure members of the shoulder strap being identical on both broad sides of the strip, the male closure members having studs and the female closure members having openings releasably receiving the studs in respective snap connections, closure members of the cups and back strap mating with closure members of the shoulder strap.

The shoulder strap can be one of a pair of shoulder straps for the brassiere or the brassiere can have a single shoulder strap. The patterns which the shoulder strap or shoulder straps can assume can be varied.

For example, the shoulder strap can be of a length enabling the shoulder strap to pass in a halter pattern from one of the cups about a neck of a wearer to the other of the cups.

Alternatively, the shoulder strap is of a length enabling two of the shoulder straps to pass in a cross pattern from each of the cups behind a wearer and to cross on the back of the wearer to closure members of the back strap on opposite sides of the back strap from the cups.

In another alternative the shoulder strap is of a length enabling two of the shoulder straps to pass in a regular pattern from each of the cups to closure members of the back strap on the same sides of the back strap as the cups.

In still a further alternative the shoulder strap is of a length enabling the shoulder strap to pass in a single diagonal pattern from one of the cups around the neck of a wearer diagonally to a closure member of the back strap on the same side of the back strap as the one of the cups.

In still another alternative the shoulder strap is of a length enabling the shoulder strap to pass in a back free body wrap pattern from one of the cups over a shoulder behind a wearer, around a front of the wearer, around a back of the wearer over the other shoulder of the wearer to the other cup.

It will be apparent that the closure members can be composed entirely of plastic, for example, a polyamide or polyoxy methylene and can be injection molded on the respective strip and that the strip can be highly flexible, e.g. of polyurethane.

Since each of the closure members is identical in structure on opposite sides of the strip, the strap is reversible. The male closure members, therefore, are double male members while the female closure members are double female. The strips may be composed of fabric as well.

BRIEF DESCRIPTION OF THE DRAWING

The above and other objects, features, and advantages will become more readily apparent from the following description, reference being made to the accompanying drawing in which.

SPECIFIC DESCRIPTION

Figure 2:
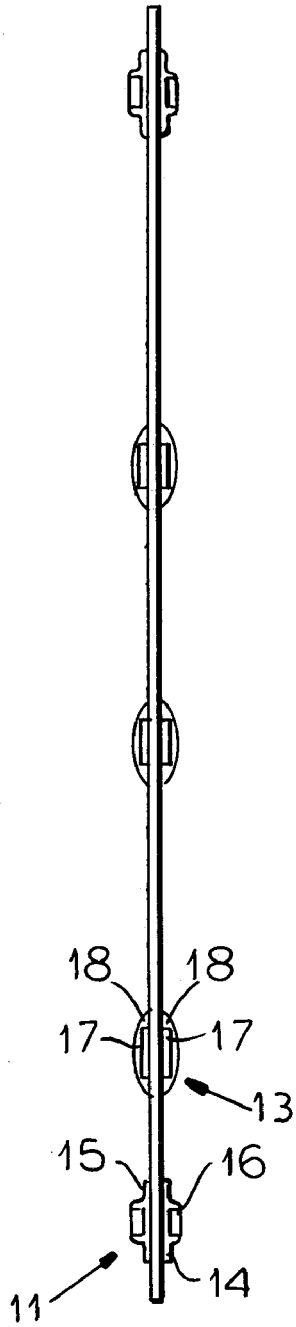
FIG. 2 is a side view showing the closure members of the strap of FIG. 1 in cross section.
Figure 1:
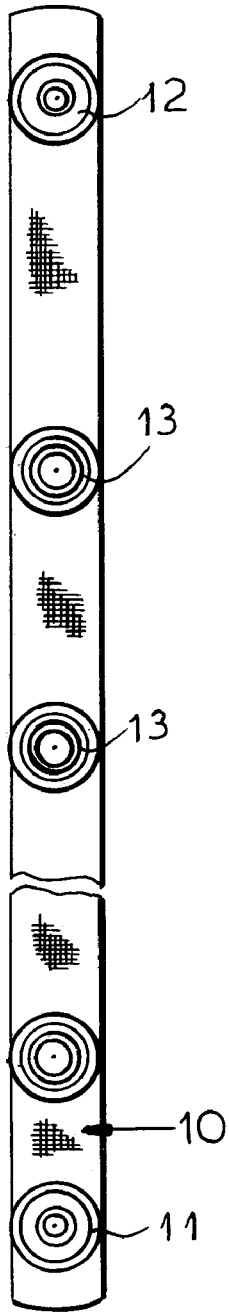
FIG. 1 is a plan view of a strap according to the invention.

In FIGS. 1 and 2, we have shown a shoulder strap which can be used, for example, for the halter pattern to be described in greater detail hereinafter or the single diagonal pattern and which can have a length of 540 mm, for example, and comprises a strip 10 having double male closure members 11 and 12 at opposite ends thereof and a number of double female closure members 13 spaced apart along the strip. The strip may be a flexible plastic, such as polyurethane or a fabric as shown and the closure members may be injection molded onto the strip. Each of the closure members 11 to 13 is generally annular and the male closure members 11 and 12, can have annular flanges 14 and 15, sandwiching the strip between them (FIG. 2) and studs 16 which flair outwardly slightly but can be press fitted into sockets 17 formed in rings 18 of the female members 13 on opposite sides of the strip.

Figure 4:
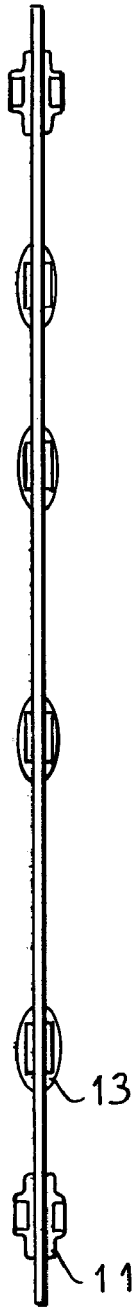
FIG. 4 is a view similar to FIG. 2 for the strap of FIG. 3.
Figure 3:
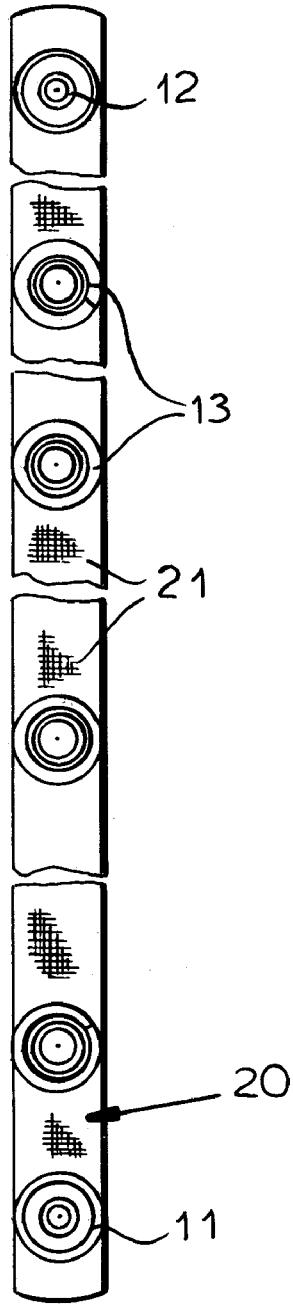
FIG. 3 is a view similar to FIG. 1 of another strap.

In FIGS. 3 and 4, we have shown a strap 20 comprising the strip 21 and the male and female closure members 11 to 13 as previously disclosed. The length of this strap may be 480 mm and the strap can be used for the halter pattern, the regular pattern, the body wrap patterns or the cross pattern which will be described in greater detail thereinafter.

Figure 5:
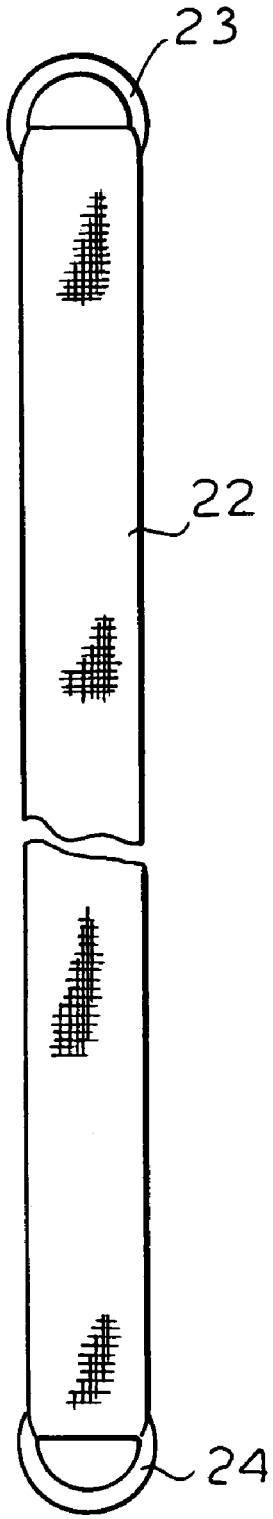
FIG. 5 is an elevational view of an extender for the straps of FIG. 1 or 3.
Figure 6:
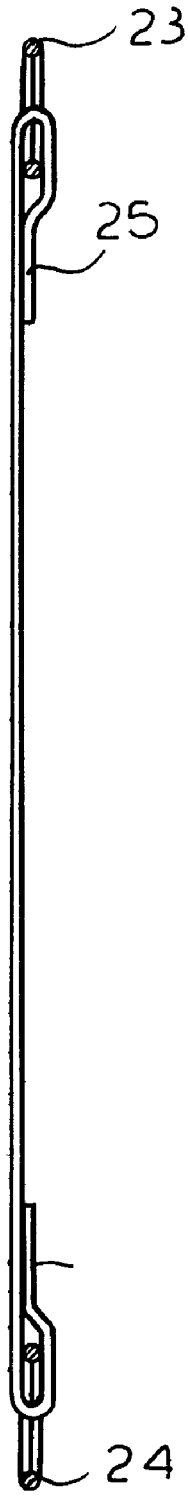
FIG. 6 is a side view of that extender with the rings thereof shown in section.

Each of the straps of FIGS. 1 and 3 can be extended by the extender shown in FIGS. 5 and 6 which can comprise a strip 22 of fabric or flexible plastic whose ends pass through rings 23 and 24 and are heat sealed or stitched to the body of the strip 22 as shown at 25 and 26 in FIG. 6.

Figure 14:
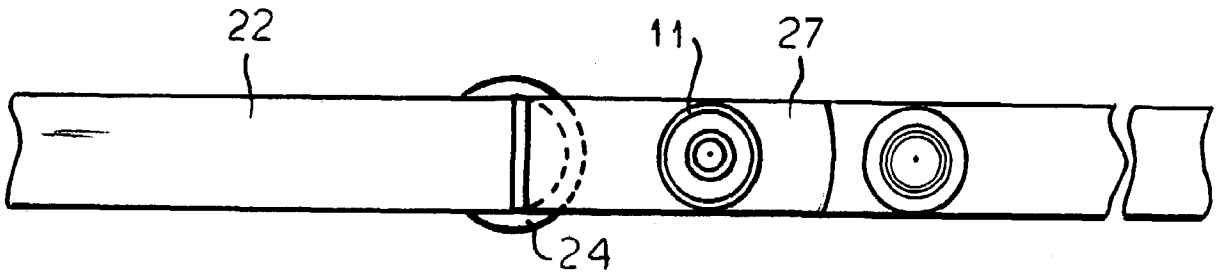
FIG. 14 is an elevational view showing still another extended strap.

To extend the strap of FIG. 1, for example, an end 27 thereof is passed through a ring 24, for example and the respective male closure member 11 is pressed into an underlying female closure member to secure the folded over end 27 in place (FIG. 14).

Figure 12:
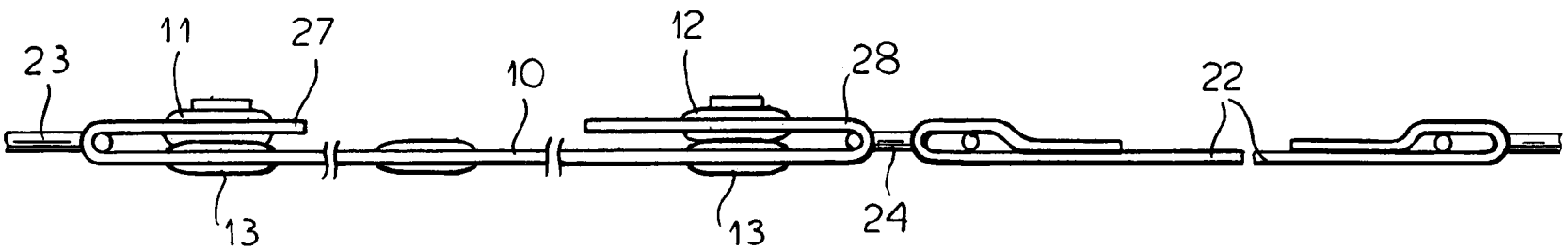
FIG. 12 is a side elevational view partly broken away showing an extended strap in accordance with the invention.

In FIG. 12, ends of this type are shown at 27 and 28 with the male closure members 11 and 12 fitted into female closure members 13 of the strip 11 after passing through rings 23 and 21 of two different extenders 22.

Figure 13:
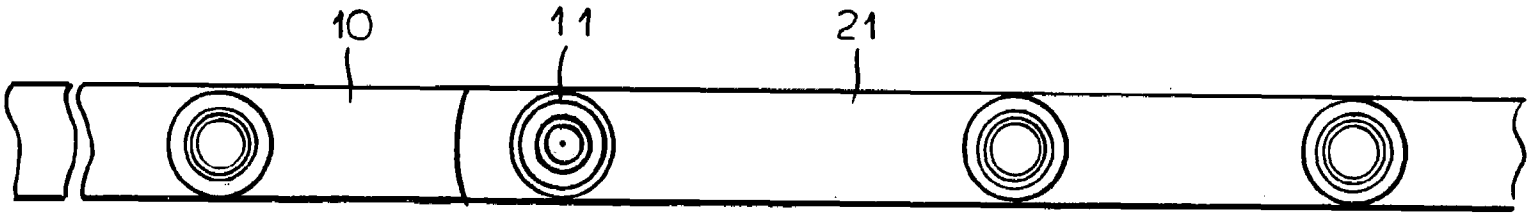
FIG. 13 is a plan view illustrating another extended strap arrangement.

FIG. 13 shows that each of the straps 10 or 21 can be extended by press fitting the male closure 11 of each strap into a female closure of the two strip.

Figure 7:
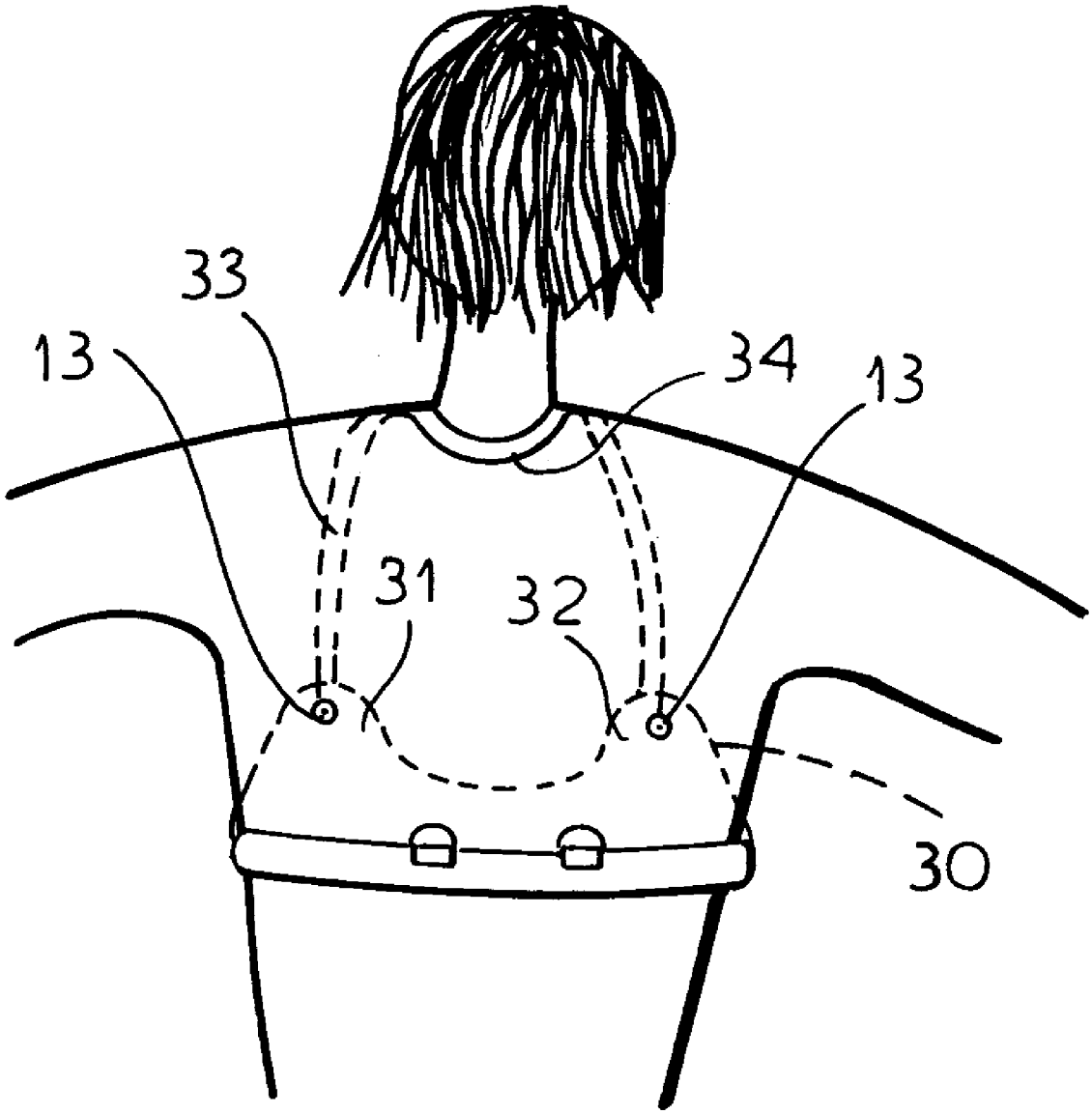
FIG. 7 is a view of a brassiere from the rear illustrating a halter neck shoulder strap pattern in accordance with the invention.

In FIG. 7, we have shown the halter pattern 30 having two cups 31 and 32, each with a female closure member 13. In this case, the strap 33, which can be extended as necessary, passes from the closure member 13 of one cup, around the neck of the user, in a loop 34 and back to the closure member 13 of the other cup 13.

Figure 8:
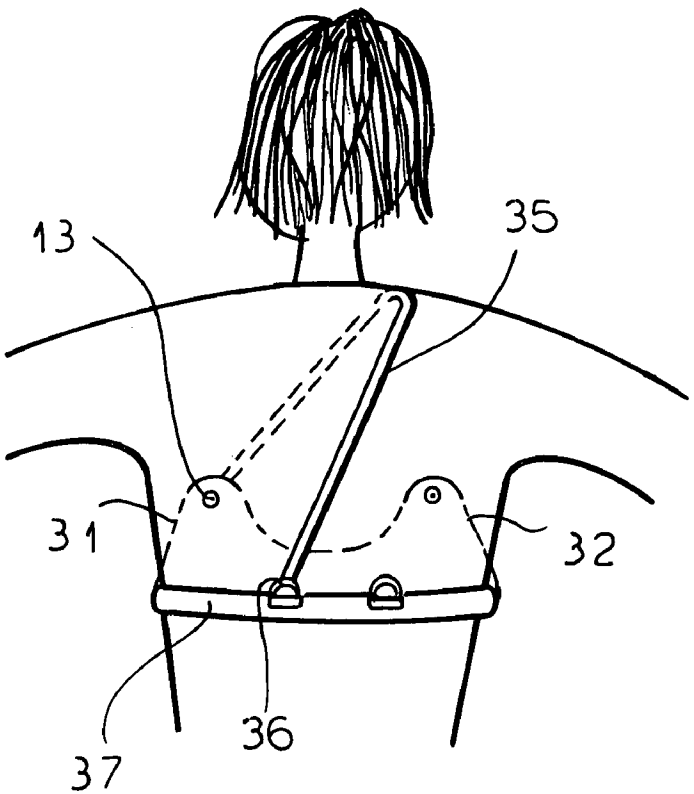
FIG. 8 is a view similar to FIG. 7 with a sectional diagonal strap pattern.

In the embodiment of FIG. 8, which can be termed a single diagonal pattern, the strap 33 passes from a ring 36 on the back strap 37 of the brassiere over the opposite shoulder of the user to cup 31 at the same side as the ring 36 so that the strap crosses the back of the wearer diagonally and crosses the front of the wearer diagonally as well.

Figure 9:
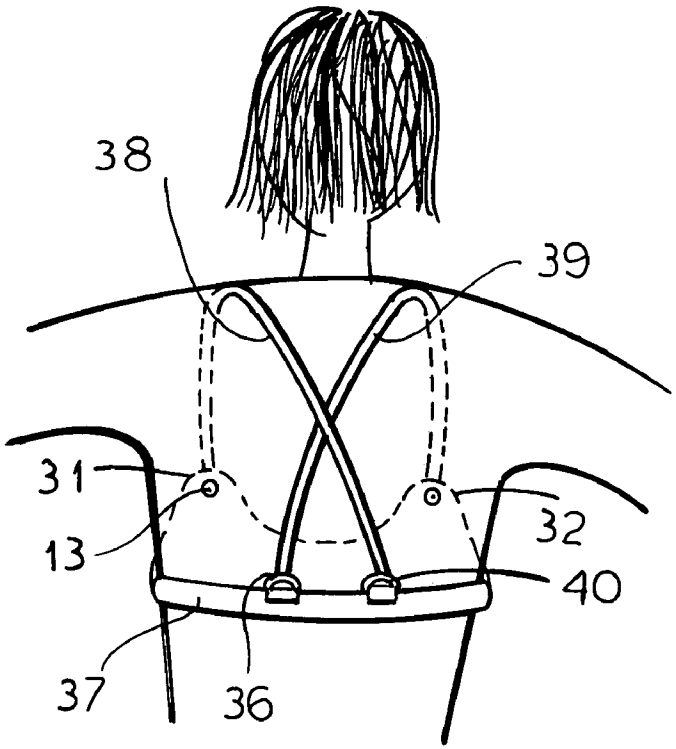
FIG. 9 is a view similar to FIG. 7 with a crossed strap pattern.

In the pattern shown in FIG. 9, two strips 38 and 39 are provided. One strap passes from the left cup 31 across the left shoulder to a ring 40 of the back strap 37 at the right hand side thereof while the other strap 39 passes from the right cup 32 over the right shoulder to the ring 36 at the left side so that the straps 38 and 39 cross at the back of the wearer.

Figure 11:
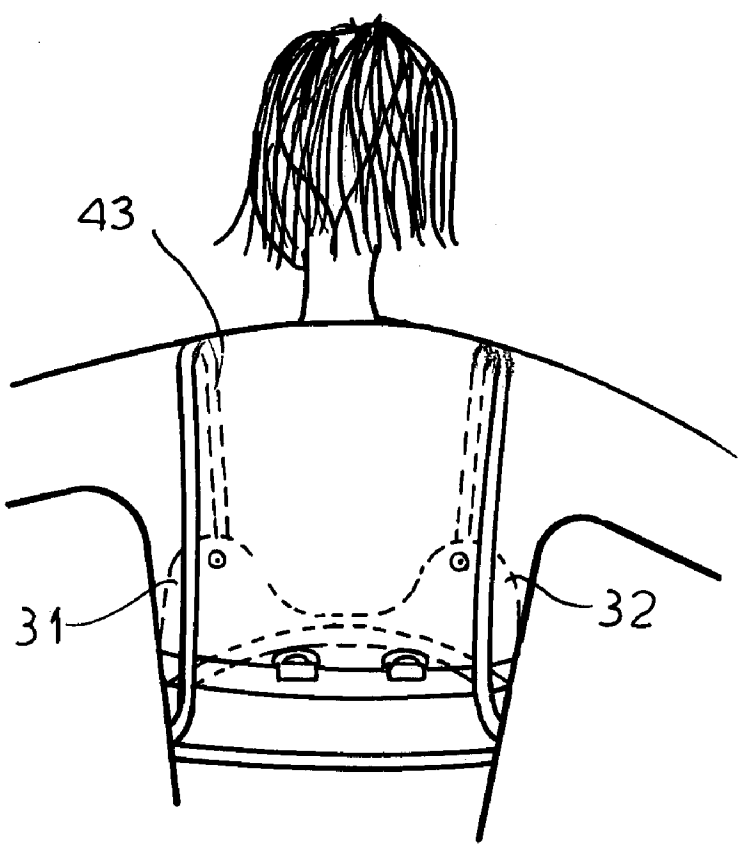
FIG. 11 is a view similar to FIG. 7 of a back-free body wrap pattern.
Figure 10:
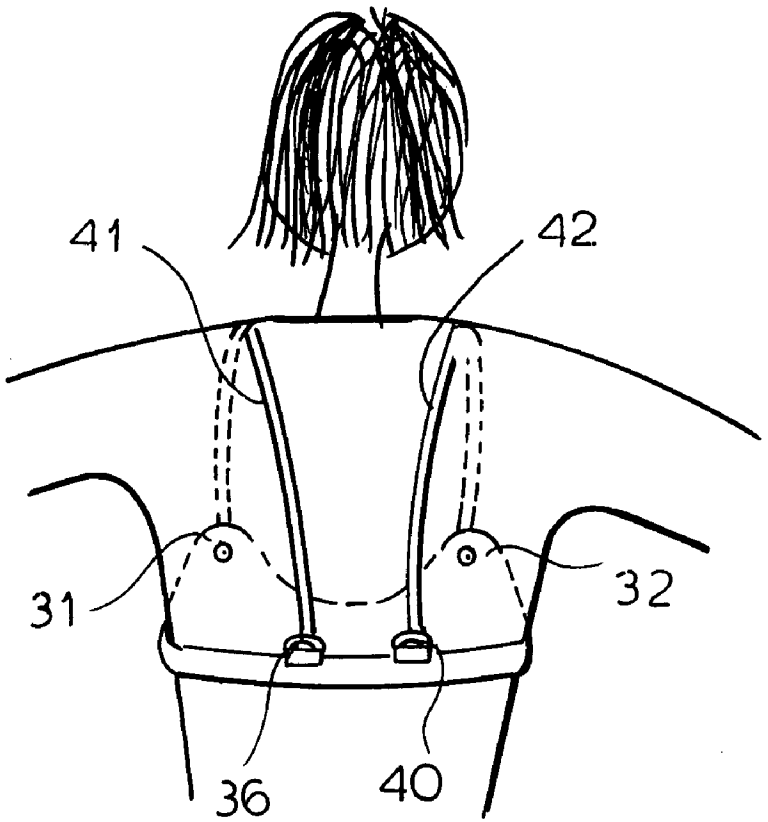
FIG. 10 is a view similar to FIG. 7 with a regular strap pattern.

A regular pattern for two straps is shown in FIG. 10 wherein the strap 41 and 42 at the left and right sides of the wearer pass respectively from the left cup 31 and the right cup 32 over the right and left shoulders to the rings 36 and 40 at the right and left sides respectively. In the full body wrap arrangement of FIG. 11, a single strap 43 passes from the left cup 31 over the left shoulder by the wearer around the body of the wearer and then over the right shoulder to terminate at the right cup 32.

Where the straps are connected to the rings 36 and 40 the strap may pass through the rings and can be secured as shown in FIG. 12 for the connection of the strap 10 to the rings 23 and 24.

We claim:

1. A brassiere comprising a pair of brassiere cups each having a respective annular snap closure member;

a back strap extending between the cups and around a back of a wearer of the brassiere and having a pair of spaced-apart annular snap closure members; and a reversible adjustable shoulder strap comprising a flexible strip having two opposite ends and two broad sides extending between the opposite ends, the strip being formed at the opposite ends on each of the sides with an outer annular snap closure members and inward of each outer snap closure member with a respective inner annular closure member, one of said closure members on each side at each end being male and having a stud and the other of said closure members on each side at each end being female and having an opening in which a one of the studs is releasably receivable to form a snap connection, the closure members of said shoulder strap being identically configured on both broad sides of said strip, the closure members of said cups and back strap being releasably receivable in a snap connection with closure members of said shoulder strap.

2. The brassiere defined in claim 1 wherein said shoulder strap is of a length enabling said shoulder strap to pass in a halter pattern from the closure member of one of said cups about a neck of a wearer to the closure member of the other of said cups.

3. The brassiere defined in claim 1 wherein said shoulder strap is of a length enabling two of said shoulder straps to pass from the closure members of said cups to behind a wearer and there to cross on the back of said wearer and terminate at the closure members of said back strap on opposite sides of said back strap from the respective cups.

4. The brassiere defined in claim 1 wherein said shoulder strap is of a length enabling two of said shoulder straps to pass generally parallel to each other from said cups to the closure members of said back strap on the same sides of said back strap as said cups.

5. The brassiere defined in claim 1 wherein said shoulder strap is of a length enabling said shoulder strap to pass in a single diagonal pattern from one of said cups around the neck of a wearer diagonally to a closure member of said back strap on the opposite side of said back strap as said one of said cups.

6. The brassiere defined in claim 1 wherein said shoulder strap is of a length enabling said shoulder strap to pass in a back free body wrap pattern from one of said cups over a shoulder behind a wearer, around a front of said wearer, around a back of said wearer over the other shoulder of the wearer to the other cup.

7. The brassiere defined in claim 1 wherein said male closure members are the outer closure members.

8. The brassiere defined in claim 7, further comprising another strip having said male and female closure members thereon connected by at least one of said closure members to the first-mentioned strip, thereby extending a length of said shoulder strap.

9. The brassiere defined in claim 8, further comprising an extender comprising a flexible strip formed with rings on ends thereof through which a strip carrying said closure members can pass, thereby extending a length of said shoulder strap.

10. The brassiere defined in claim 1, further comprising another strip having said male and female closure members thereon connected by at least one of said closure members to the first-mentioned strip, thereby extending a length of said shoulder strap.

11. The brassiere defined in claim 1, further comprising an extender comprising a flexible strip formed with rings on ends thereof through which a strip carrying said closure members can pass, thereby extending a length of said shoulder strap.

* * * * *